United States Patent [19]

McIntire et al.

[11] 4,316,929

[45] Feb. 23, 1982

[54] HOT MELT SIZING COMPOSITIONS COMPRISING AN ACRYLIC ACID-ALKYL (METH)ACRYLATE TERPOLYMER

[75] Inventors: John M. McIntire; James M. Hawkins; Raymond N. Vachon, all of Kingsport, Tenn.

[73] Assignee: Eastman Kodak Company, Rochester, N.Y.

[21] Appl. No.: 34,227

[22] Filed: Apr. 30, 1979

[51] Int. Cl.[3] ..... B32B 27/04; C08K 5/09; C08F 20/64; C08F 220/64

[52] U.S. Cl. ..... 428/262; 260/23 AR; 260/29.6 TA; 526/240; 526/317; 428/265; 428/375; 428/394

[58] Field of Search ..... 260/23 AR, 29.6 TA; 526/317, 240; 428/262, 265, 375, 394

[56] References Cited

U.S. PATENT DOCUMENTS

| | | | |
|---|---|---|---|
| 2,084,386 | 6/1937 | Crawford | 260/23 AR |
| 3,607,615 | 9/1971 | Hatakeyama et al. | 428/337 |
| 3,740,367 | 6/1973 | Winkelblech | 260/30.4 R |
| 3,980,602 | 9/1976 | Jakubauskas | 260/29.6 TA |
| 4,048,369 | 9/1977 | Johnson | 428/262 |
| 4,081,383 | 3/1978 | Warburton et al. | 428/265 |
| 4,082,883 | 4/1978 | Malpass et al. | 260/31.2 XA |
| 4,115,331 | 9/1978 | Tominaga | 260/29.6 TA |

OTHER PUBLICATIONS

Polymer Handbook, "Brandrup et al", 1975, 2nd Edition, III, 140–142 and 147.

Derwent Abstract 42357 V/23, Asada Chem. Ind. Co., "Additive For Paper Sizing Agents . . . ", Nov. 26, 1973.

*Primary Examiner*—Herbert J. Lilling

*Attorney, Agent, or Firm*—John F. Stevens; Daniel B. Reece, III

[57] ABSTRACT

Sizing compositions comprising a terpolymer derived from (a) about 50 to about 70% by weight of at least one lower alkyl acrylate, (b) about 20 to about 40% by weight of at least one lower alkyl methacrylate, and (c) about 10% by weight acrylic acid or salt thereof.

Such sizing compositions are especially useful when applied as a hot melt to a variety of filaments, yarns, fabrics, etc.

8 Claims, No Drawings

HOT MELT SIZING COMPOSITIONS COMPRISING AN ACRYLIC ACID-ALKYL (METH)ACRYLATE TERPOLYMER

BACKGROUND OF THE INVENTION

1. Field of the Invention

This invention relates to the sizing of textile yarns, and more particularly to melt sizing with compositions later removable by aqueous means.

2. Description of the Prior Art

The art of textile sizing contains many examples of solutions and dispersions of sizes in water and/or organic solvents. Such compositions inevitably require a slow and expensive drying step after application to yarns. A few examples are known of melt sizes, which do not require removal of solvent, these sizes being based in general upon waxes and other water-insolubles. U.S. Pat. No. 3,466,717 is directed to the application of such a wax-based melt size, removable only by nonaqueous solvents after processing. Besides this restriction, wax sizes have the futher deficiency that they lack the film strength, adhesion, flexibility, and ready variability and control of melt viscosity which are inherent in the tougher polymer-based melt sizes of the present invention.

Polymers high enough in molecular weight to be good film formers generally give melts having excessively high viscosities and slow solidification rates. Such polymers, if applied as melt sizes, would therefore be expected to flow poorly onto and throughout the fibers of a yarn, and to require application of excessive cooling means and times for solidification.

U.S. Pat. No. 4,082,883 relates to the intimate combination of a film-forming thermoplastic polymer and a melt-compatible non-polymeric solid modifier, which is said to be readily meltable, quick-setting, essentially water or alkali soluble, and thus capable of melt application to and extraction by aqueous solvents from textile filaments, yarns and fabrics. The melt modifiers are said to reduce the viscosity of the polymer melt and at the same time to effect an increase in the setting rate. This patent suggests a wide range of suitable thermoplastic polymers which may be used, including various copolyesters, acrylic and methacrylic acid copolymers, vinyl acetate copolymers, phosphonate copolymers, etc. Example 19 relates to the use of 40 g of a terpolymer of 56% ethyl acrylate, 33% methyl methacrylate and 11% methacrylic acid, modified with 60 g of adipic acid. A melt made with 60% polymer and 40% adipic acid was too viscous to be effectively applied to yarn. The present invention provides a composition which includes no greater than about 5% of a particular acid modifier, and includes acrylic acid rather than methacrylic acid in the terpolymer. The composition according to this invention containing very small amounts of acid modifier is very desirable because it is essentially smokeless and odorless. Also, use of acrylic acid rather than methacrylic acid provides advantages such as ready polymerization of the terpolymer, reactivity ratios of the monomers are closer, and the glass transition temperature is maintained at a low level.

SUMMARY OF THE INVENTION

The present invention provides textile sizing compositions comprising a terpolymer derived from (a) about 50 to about 70% by weight of at least one alkyl acrylate wherein the alkyl group contains from 1 to 4 carbon atoms, (b) about 20 to about 40% by weight of at least one alkyl methacrylate wherein the alkyl group contains from 1 to 4 carbon atoms, and (c) about 10% by weight acrylic acid or salt thereof.

The compositions according to this invention are especially useful as sizing for textile filaments, yarns, fabrics, etc., of various materials such as, for example, polyester, rayon, polyolefin, polyamide, cotton, wool, etc. The compositions are particularly useful because they can be applied as a hot melt and removed by water. The compositions according to this invention are also fast to solidify, allowing wind-up of the substrate at high speeds; and have relatively low viscosities permitting smooth and uniform application to a variety of fibers. The compositions when used as a size are also flexible, have good adhesion and good blocking resistance.

DETAILED DESCRIPTION OF THE INVENTION

According to the present invention the textile sizing composition comprises a terpolymer derived from (a) about 50 to about 70% by weight of at least one alkyl acrylate wherein the alkyl group contains from 1 to 4 carbon atoms, (b) about 20 to about 40% by weight of at least one alkyl methacrylate wherein the alkyl group contains from 1 to 4 carbon atoms, and (c) about 10% by weight acrylic acid or salt thereof.

The terpolymer is prepared by conventional polymerization procedures well known in the art. Generally, the alkyl acrylate, alkyl methacrylate and acrylic acid are stirred under a nitrogen atmosphere with a polymerization initiator, chain transfer agent and volatile organic solvent. The terpolymer should have a glass transition temperature (Tg) of between about 22° C. and about 40° C. as measured by Differential Scanning Clarorimeter, (Perkin-Elmer, Model 2) and an inherent viscosity (I.V.) of between about 0.1 and about 0.15. The terpolymer is a thermoplastic solid at room temperature, and may be molded into shapes which may be conveniently handled such as, for example, rods or pellets.

The alkyl acrylate used in the terpolymer of this invention may have from 1 to 4 carbon atoms in the alkyl group. Methyl acrylate is preferred, and is commercially available. The alkyl acrylate may be used in amounts of between about 50 and about 70% by weight of the total weight of alkyl acrylate, alkyl methacrylate and acrylic acid. About 60% by weight methyl acrylate is preferred.

The alkyl methacrylate used in the terpolymer of this invention may have from 1 to 4 carbon atoms in the alkyl group. Methyl methacrylate is preferred, and is commercially available. The alkyl methacrylate may be used in amounts of between about 20 and about 40% by weight of the total weight of alkyl acrylate, alkyl methacrylate and acrylic acid. About 30% by weight methyl methacrylate is preferred.

The acrylic acid used in the terpolymer of this invention is commercially available. It is used in amounts of about 10% by weight, based on the total weight of alkyl acrylate, alkyl methacrylate and acrylic acid. Metal and ammonium salts of acrylic acid may be used if desired, so long as such salt has carboxylic groups sufficient in number to impart water or alkali solubility.

The textile size composition comprising the terpolymer described above may be modified, if desired, by blending therewith up to about 5% by weight of at least one aliphatic monocarboxylic acid having from 8 to 18 carbon atoms, the weight being based on the combined weight of terpolymer and acid. When a modifier is used, stearic acid is preferred modifying acid. Use of modifying acids in excess of about 5% is undesirable because amounts in excess of about 5% tend to cause objectionable smoking and odors. When the modifying acid is used, it may conveniently be melt blended with the terpolymer. On the other hand, the terpolymer and modifying acid may be dissolved in a common solvent, and mixed, followed by evaporation of the solvent.

The I.V. of the terpolymer is determined at 23° C. using 0.5 gram of polymer per 100 ml of a solvent consisting of a 60/40 mixture of phenol/tetrachloroethane.

The size composition of the invention may be used in various ways. However, a preferred way of using the composition involves utilizing a grooved rotating roller which is heated while a block of the melt size is forced against the roller to be transferred to yarn passing through the grooves of the roller.

The melt sizes may suitably be made and used by melting the components together and directly applying the melts to yarn. This operation, however, is likely to involve long retention times in the molten state of undesirably large bodies of molten size. A preferred procedure is to cast the preliminary melts in sticks, blocks, or sheets of such dimensions as to permit their controlled incremental melting when an edge of the casting is pressed against the grooved hot roll applicators of the copending application.

When a higher degree of yarn lubricity and flexibility is required than obtained with a melt made from only the aforesaid composition, minor proportion of melt-miscible and aqueous-extractable yarn lubricant may also be blended into the melt. The proportions of this latter component should be held at relatively low levels to prevent an adverse effect upon the solidification behavior of the size. Typical suitable lubricants for this purpose are water-soluble polyurethanes, polyethylene glycols, waxes and the like.

The composition according to this invention produces a melt displaying a significantly reduced melt viscosity and especially a rapid setup and absence of tackiness when the size yarn is led away from the hot size applicator. The combination melt has the further advantage that it can be removed by aqueous means.

In the context of this invention a meltable composition is defined as one having a degree of thermoplasticity sufficient to produce adequate flow onto and among the fibers of a yarn when the hot polymer, diluted by the melted or dissolved solid modifier, is applied without significant pressure to the yarn.

Besides the yarn lubricants previously mentioned as potential third components in the melt mixtures, other agents such as antioxidants, light or heat stabilizers, coloring material, and the like may be added to the molten size combination if desired.

The following examples are submitted for a better understanding of this invention.

EXAMPLE 1

A terpolymer is prepared from the following:

60 parts methyl acrylate
30 parts methyl methacrylate
10 parts acrylic acid
1.5 parts azobis(isobutyronitrile)(initiator)
1.0 parts tertiary dodecyl mercaptan (chain transfer agent)
900 parts methyl ethyl ketone (solvent)

The above ingredients are stirred under nitrogen atmosphere for 18 hours. An additional 0.75 parts of azobis(isobutyronitrile) are then added and stirred 5 hours more.

The solvent is evaporated in polyethylene trays at 50° C. in steam heated oven. The recovered polymer is dried an additional 4 hours at 80° C. under vacuum. Properties are found to be:

I.V.=0.12
Tg=35° C.
Acid No.=63.2
96+% Conversion

EXAMPLE 2

Example 1 is repeated except 5 parts of stearic acid is added to the solution while at 70° C. The solvent is evaporated in polyethylene trays at 50° C. in a steam heated oven, then 4 hours at 80° C. under vacuum. Properties are found to be:

I.V.=0.12
Tg=35° C.
Acid No.=63.2
96+% Conversion

EXAMPLE 3

To a 300 ml, 3-necked flask is added 45 g of a 60/30/10 methyl acrylate/methyl methacrylate/acrylic acid copolymer and 2.3 g of stearic acid (90% pure). The flask is fitted with a nitrogen inlet tube, a condenser and a mechanical stirrer. The mixture is flushed with nitrogen for 30 minutes. The flask is then placed in a metal bath controlled at 165° C. The mixture is melted and blended intimately for 30 minutes.

The blend is cooled, cut up and ground into a powder. The powder is molded into 4 inch$\times\frac{1}{4}$ inch rods for use on a hot-melt size applicator.

The blend has a melt viscosity of 4800 cp at 165° C., a Tg of 23° C., an I.V. of 0.137. Films of the blend spread out on silicone release paper, set up in <2 sec. from the melt, and can be easily desized with dilute $Na_2CO_3$.

EXAMPLE 4

Example 3 is repeated except that a 96/4 blend of a 50/40/10 methylacrylate/methyl methacrylate/acrylic acid copolymer/stearic acid is prepared. The blend was a melt viscosity of 8400 cp at 165° C., a Tg of 30° C., an I.V. of 0.139. Films of the blend have good strength and elongation and set up in <2 sec. from the melt. The blend is readily dispersible in dilute $Na_2CO_3$ containing Triton X-100.

EXAMPLE 5

The blends described in Examples 3 and 4 are molded into 4"$\times\frac{1}{4}$" rods at 100° C. The rods are fed at a constant rate to a grooved roll heated at 177° C. A 22/1, 65/35 polyester/cotton yarn is passed through the grooves containing the molten size and is wound on a package at 100 yards/minute. The sized yarn is non-tacky within 1 or 2 feet from the applicator, and does not block on the package. The sized yarns are no longer hairy and have significantly improved abrasion resistance as compared to the unsized yarn.

The size is readily removed from the yarn by scouring in 0.1% $Na_2CO_3$ containing 0.1% Triton X-100 at 165°-180° C.

Unless otherwise indicated, all percentages, ratios, parts, etc., are on a weight basis.

The invention has been described in detail with particular reference to preferred embodiments thereof, but it will be understood that variations and modifications can be effected within the spirit and scope of the invention.

We claim:

1. A hot melt textile sizing composition comprising a terpolymer of (a) about 50 to about 70% by weight of at least one alkyl acrylate wherein the alkyl group contains from 1 to 4 carbon atoms, (b) about 20 to about 40% by weight of at least one alkyl methacrylate wherein the alkyl group contains from 1 to 4 carbon atoms, and (c) about 10% by weight acrylic acid or salt thereof, said terpolymer being dispersible in dilute sodium carbonate, and having a glass transition temperature of between 22° and about 40° C. and an I.V. of between about 0.1 and about 0.15 measured at 23° C. using 0.5 gram of polymer per 100 ml of a solvent consisting of a 60/40 mixture phenol/tetrachloroethanol.

2. Composition according to claim 1 wherein the alkyl acrylate is methyl acrylate.

3. Composition according to claim 1 wherein the alkyl methacrylate is methyl methacrylate.

4. Composition according to claim 1 wherein said alkyl acrylate is methyl acrylate and said alkyl methacrylate is methyl methacrylate.

5. Composition comprising the terpolymer described in claim 1 and from about 0.1 to about 5.0 by weight, based on the weight of the composition of at least one aliphatic monocarboxylic acid having from 8 to 18 carbon atoms.

6. Composition according to claim 5 wherein the monocarboxylic acid is stearic acid.

7. A textile material sized with the composition of claim 1.

8. A textile material sized with the composition of claim 5.

* * * * *